US005125767A

United States Patent [19]

Dooleage

[11] Patent Number: 5,125,767

[45] Date of Patent: Jun. 30, 1992

[54] METHOD AND APPARATUS FOR CONSTRUCTING HYDRAULIC DAMS AND THE LIKE

[76] Inventor: David Dooleage, P.O. Box 206, Carlotta, Calif. 95528

[21] Appl. No.: 23,693

[22] Filed: Mar. 9, 1987

[51] Int. Cl.[5] ..... E02B 3/00

[52] U.S. Cl. ..... 405/115; 405/21; 405/91; 405/114

[58] Field of Search ..... 405/15, 16, 21, 20, 405/30, 91, 115, 107

[56] References Cited

U.S. PATENT DOCUMENTS

| | | | |
|---|---|---|---|
| 3,086,369 | 4/1963 | Brown | 405/172 |
| 3,191,386 | 6/1965 | Wiegel et al. | 405/25 |
| 3,373,568 | 3/1968 | Hornbostel | 405/21 |
| 3,374,635 | 3/1968 | Crandall | 405/18 |
| 3,834,167 | 9/1974 | Tabor | 405/115 |
| 3,957,098 | 5/1976 | Hepworth et al. | 405/19 X |
| 4,162,865 | 7/1979 | Aubet | 405/154 |
| 4,501,788 | 2/1985 | Clem | 405/107 X |
| 4,555,201 | 11/1985 | Paoluccio | 405/21 X |
| 4,690,585 | 9/1987 | Holmberg | 405/15 X |
| 4,729,691 | 3/1988 | Sample | 405/15 X |
| 4,784,520 | 11/1988 | Stevens | 405/30 X |
| 4,799,821 | 1/1989 | Brodersen | 405/115 |

FOREIGN PATENT DOCUMENTS

| | | | |
|---|---|---|---|
| 2302111 | 9/1976 | France | 405/289 |
| 0657884 | 9/1986 | Switzerland | 405/115 |

*Primary Examiner*—Dennis L. Taylor
*Attorney, Agent, or Firm*—M. Reid Russell

[57] ABSTRACT

Method and apparatus for making and using barriers formed from water filled bags that are suitable for damming water, directing water flow, dissipating water energy and for other purposes, wherein the apparatus comprises at least a pair of elongate, flexible and impermeable bags interlocked in side-by-side relationship and that may incorporate additional flexible, impermeable, water filled bags in the ends thereof as anchors.

7 Claims, 1 Drawing Sheet

METHOD AND APPARATUS FOR CONSTRUCTING HYDRAULIC DAMS AND THE LIKE

BACKGROUND OF THE INVENTION

1. Field of the Invention

This invention relates to structures for the damming of water courses, the bufferring of water, and the control of water flow and the like and is particularly concerned with the provisions of relatively low-cost, readily constructed, temporary damming structures.

2. Background Information

The need for easily installed dam structures and particularly for structures that are relatively inexpensive, reusable, and easily installed, even by untrained persons has long been recognized. Such structures are useful, for example, for temporary damming operations, such as may be used in farming operations and for protection against water damage that may occur from floods.

It has been recognized in the past that fluid filled, flexible dams can be used for retention of water and control of water flow. U.S. Pat. Nos. 3,246,474, 3,355,851, 3,834,167, 4,279,540, 4,299,415, and 4,314,774, for example, each show such a dam.

The above-identified patents all use an inflatable envelope that is filled with water or air and that is some way physically anchored to a water channel so that the fluid filled bag will serve as a barrier to water flow. These structures may be entirely suitable for some uses, but they are restricted in requiring anchoring structures. That is, they can only be used in locations suitable for the anchoring means and they require a significant site preparation and may even require concrete bottom and side walls in order to provide for support of the barrier.

The present invention is concerned with providing a low cost, easily constructed and placed barrier that may be used without significant site preparation and that can be used as a dam, a confinement wall, a breakwater or reef, or for many other purposes and that will, when positioned, accommodate to the particular site.

It has been found that if a single, elongate, water filled flexible bag is placed transversely to water flow as a water barricade or buffer the pressure of the continuing water against the side wall of the bag will cause the bag to roll. Consequently, such a structure is not suitable, by itself as a water barricade.

OBJECTS OF THE INVENTION

Principal objects of the present invention are to provide a water filled, flexible barricade that can be used to dam or channel water and that can be economically constructed, easily positioned—even without significant site preparation, and that will provide an effective water retention, buffer or water flow direction guide without rolling of the barrier.

Other objects are to provide a water filled barricade that is suitable for use as a small dam, even in rough watercourses; that can be readily used to quickly form a barricade to protect people, animals and facilities from flooding; and that can be advantageously employed as a breakwater, as well as for other purposes.

FEATURES OF THE INVENTION

Principal features of the invention include at least two impermeable bags of sufficient length to provide a desired barrier against water flow through a distance to be covered by said barrier.

The bags include filler means to receive water, under pressure in the filling of the bags and may include valve means to prevent undesired discharge from the bags. The bags are preferably exteriorly reinforced so that they will maintain their shape and they are interlocked along their lengths, as by another surrounding bag, a net, or other confinement structure.

According to the method of the invention, a pair of bags can be used without other bags or additional bags can be placed in a stacked arrangement to provide a larger and more stable barrier that will block or buffer water flow, that will channel water flow, as desired.

THE DRAWINGS

In the drawings:

FIG. 1 is an elevation view of a barrier of the invention, positioned as a dam in a flow channel;

FIG. 2, a top plan view of a typical barrier and bag stacked arrangement;

FIG. 3, a vertical section, taken on the line 3—3 of FIG. 1;

FIG. 4, a vertical section, taken on the line 4—4 of FIG. 1;

FIG. 5, a cross-sectional view through a dam formed from a plurality of barrier bags of the invention.

DETAILED DESCRIPTION

Figure 1:
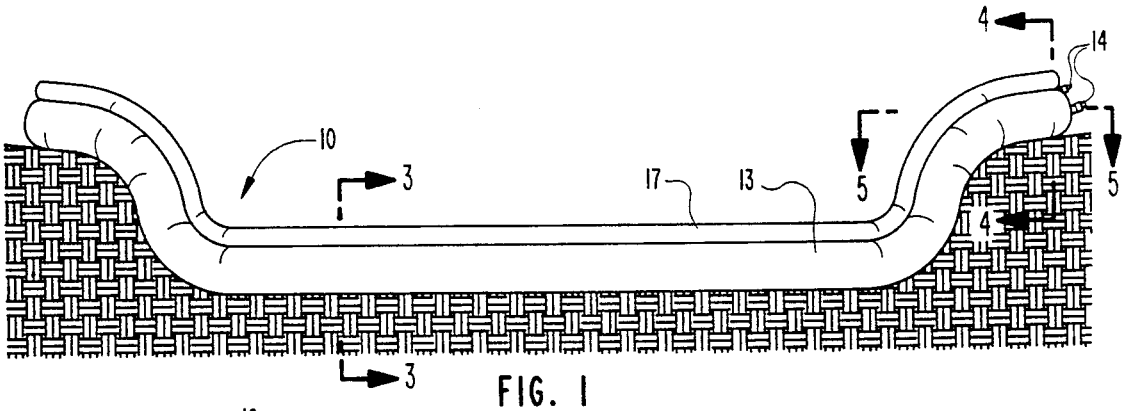

Referring now to the drawings:

In the illustrated preferred embodiment of the apparatus of the invention, the barrier, shown generally at 10, includes a pair of flexible, impermeable bags 11 and 12, held together in side-by-side relationship by a surrounding cover 13. The cover 13 is here shown as another bag but it will be apparent that other means could be provided for holding the bags together. A net, not shown, surrounding both bags 11 and 12 could be used, for example, or straps (not shown) wrapped around the bags and spaced therealong could be used.

Each of the bags 11 and 12 is made of a suitable flexible, impervious material such as vinyl plastic, reinforced neoprene rubber or reinforced butyl rubber. A filler spout 14 is provided at an end of each bag and, a valve 15 may be positioned in each filler spout to provide for opening and closing of the spout as necessary for filling and emptying of the bags. A vent tube 16 extends from the top of each bag to allow air to escape as the bag is filled with water.

When the bags 11 and 12 are filled with water, as will be hereinafter further described, the adjacent sides of the bags are in engagement and at the point of engagement will tend to rotate in opposite directions (in response to the tendency of the bags to roll) and to then become mutually locked and stable against rolling.

The filled bags 11 and 12 then serve as barriers and are suitable for use as dams, dikes, breakwaters, seawalls and for many other purposes. Additional barriers 10 and bags such as are shown at 11 and 12 may be used to construct structures of greater height. Thus, as shown, for example, another bag 17, constructed in the same manner as bags 11 and 12 may be positioned on top of barrier 10 and between the bags 11 and 12. With bag 17 positioned as described, any tendency of bag 17 to roll is countered by the tendency of bags 11 and 12 to roll. It will also be apparent that layers of bags can be placed transversely to one another to achieve a desired barrier height.

Figure 2:
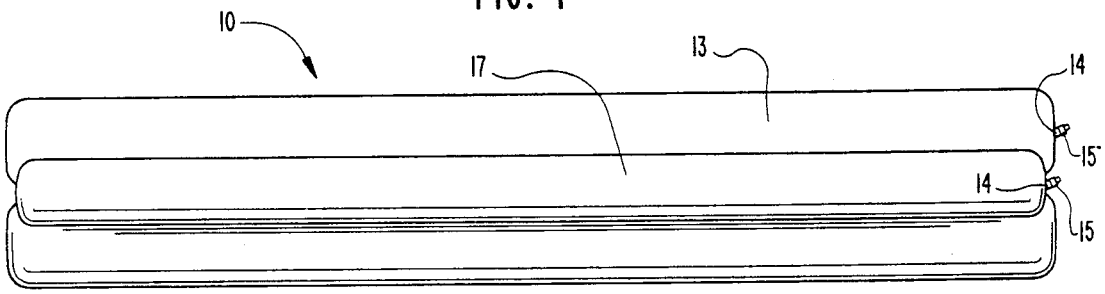
Figure 3:
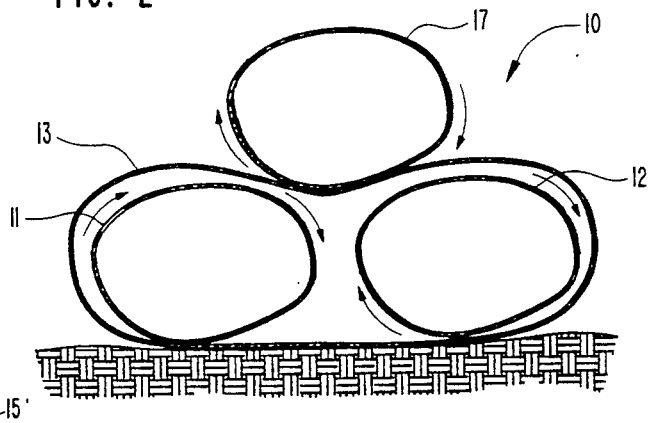
Figure 4:
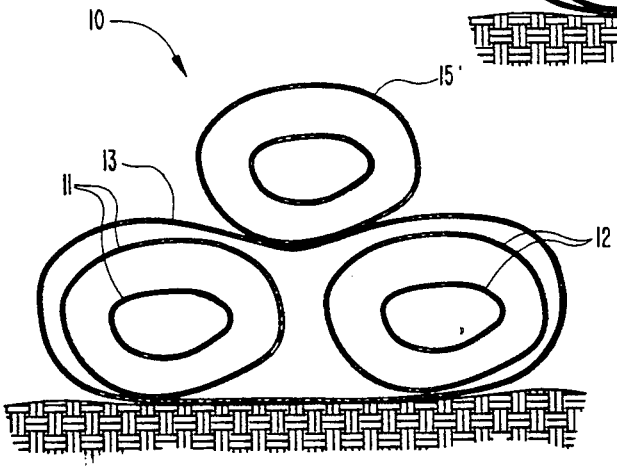
Figure 5:
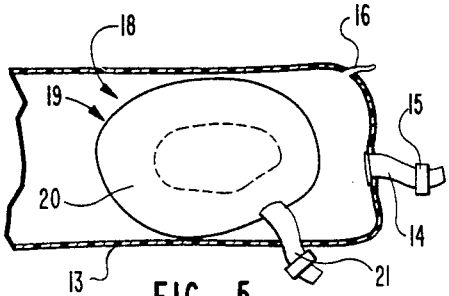

The barrier 10, and thus the bags 11 and 12, are made sufficiently long to extend the length of the area in which the barrier is to be positioned, and as shown in FIGS. 1 and 2 also onto a support area. As shown in FIGS. 1 and 2, the barrier and bag 17 extend across a channel 18, up the walls of the channel and onto the surrounding terrain. It will be apparent that the bags 11, 12 and 17 may be formed with compartments that can be individually filled and emptied.

To assist in the positioning of the barrier 10, anchor means, shown generally at 19, may be formed in the ends of one or both of the bags 11 and 12 or even intermediate the bag lengths. Each anchor means 19 comprises another bag 20 that is shaped such that when it is filled with water it will not roll. The donut-shape shown is satisfactory for most purposes since, when it is placed. flat, it will not roll.

During installation of the barrier 10, the ends thereof are placed in position and the bags 20 are filled through filler spouts 21. The filled bags 20 then hold the ends of the barrier in place while the bags 11 and 12 are filled by pumping water into them. Any additional barriers or bags used to form a pyramid are filled independently, or simultaneously with the filling of bags 11 and 12. If desired, netting or other suitable material can be used to hold all stacked bags together.

The valves 15 are desirable to make it easier to control filling of the bags and discharge from the bags but when the ends of bags 11 and 12 are held elevated water can be placed directly into the bags.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A method for constructing a barrier for use as a dam, dike, breakwater, seawall or the like, comprising:

positioning two flexible, impermeable elongate bags in side-by-side relationship, with the bags each being of a length to expend across a distance to be blocked by a barrier;

containing said elongate bags, in side-by-side relationship, in an elongate sleeve, said sleeve to fully contain and extend beyond said elongate bags ends, and is in tight fitting relationship thereto when said elongate bags are filled with water, for maintaining which filled elongate bags tightly against one another, holding the adjacent sides of said elongate bags together and prohibiting the movement of one elongate bag independent of the other;

filling which elongate bags with water and closing the ends thereof; and anchoring the opposite ends of which sleeve and elongate bags.

2. A method as in claim 1, wherein the ends of the bags are anchored in place before the bags are filled.

3. A method as in claim 2, wherein the ends of the bags are anchored using other water filled bags.

4. A barrier for use as a dam, dike breakwater, seawall or the like comprising a pair of equal length impermeable, flexible elongate bags arranged in side-by-side relationship, with adjacent bag sides in contact along their lengths, said bags each of a length to extend across a distance to be blocked as a barrier;

an elongate sleeve of a size and length to receive the pair of elongate bags fitted therein, extending beyond said elongate bag ends, fully containing said elongate bags in side-by-side relationship after said elongate bags are filled with water, said elongate sleeve holding said filled bags tightly against one another along their entire length, the one elongate bag prohibited from moving independent of the other;

by means for anchoring the opposite elongate sleeve and pair of bag ends;

means for filling each said elongate bag with water; and means for closing the ends of said filled elongate bags.

5. A barrier as in claim 4, wherein the sleeve for interlocking the bags into side-by-side relationship comprises a net surrounding the bags.

6. A barrier as in claim 4, further including another water filled bag positioned on the sleeve between the pair of bags further providing for interlocking said bags into side-by-side relationship.

7. A barrier as in claim 4, wherein the means for anchoring the opposite elongate sleeve and pair of bag ends is a pair of end bags, one at each sleeve end and extending across which pair of bag ends; and;

means for filling with water and closing which pair of end bags.

* * * * *